US005396757A

United States Patent [19]

Kobayashi et al.

[11] Patent Number: 5,396,757

[45] Date of Patent: Mar. 14, 1995

[54] DIRECTLY MOTOR-DRIVEN SPINDLE ASSEMBLY

[75] Inventors: Hideaki Kobayashi, Sakura; Takeshi Obata, Funabashi, both of Japan

[73] Assignee: Hitachi, Ltd., Tokyo, Japan

[21] Appl. No.: 925,265

[22] Filed: Aug. 6, 1992

Related U.S. Application Data

[63] Continuation of Ser. No. 639,108, Jan. 9, 1991, abandoned.

[30] Foreign Application Priority Data

Jan. 12, 1990 [JP] Japan ..... 2-3589
Sep. 14, 1990 [JP] Japan ..... 2-242322

[51] Int. Cl.[6] ..... D01H 13/00; H02K 7/10

[52] U.S. Cl. ..... 57/100; 57/129; 310/80; 310/157

[58] Field of Search ..... 57/81, 92, 93, 100, 57/129, 130, 133, 134, 135; 310/157, 209, 80

[56] References Cited

U.S. PATENT DOCUMENTS

| | | | |
|---|---|---|---|
| 3,361,947 | 1/1968 | Schlebusch | 310/209 |
| 3,742,268 | 6/1973 | Volkrodt | 57/100 X |
| 3,936,685 | 2/1976 | Glockner et al. | 310/209 |
| 3,965,380 | 6/1976 | Stepina | 310/209 X |
| 3,978,355 | 8/1976 | Höfert et al. | 310/209 X |
| 4,519,205 | 5/1985 | Gubler | 57/100 X |
| 4,816,712 | 5/1989 | Tanaka | 310/80 X |
| 4,833,873 | 5/1989 | Kobayashi et al. | 57/100 |
| 4,886,991 | 12/1989 | Braun | 310/157 X |
| 5,010,722 | 4/1991 | Yamaguchi et al. | 57/100 X |

FOREIGN PATENT DOCUMENTS

| | | | |
|---|---|---|---|
| 27805 | 9/1930 | Italy | 57/100 |
| 538127 | 1/1956 | Italy | 57/100 |
| 60-139153 | 7/1985 | Japan . | |

*Primary Examiner*—Daniel P. Stodola
*Assistant Examiner*—Michael R. Monsen
*Attorney, Agent, or Firm*—Antonelli, Terry, Stout & Kraus

[57] ABSTRACT

A directly motor-driven spindle assembly in a rotary shaft having one end supported on a bearing and the other end connected to a load a, driving apparatus fixed to the rotary shaft to rotate the rotary shaft, and control apparatus for controlling the movement of the rotary shaft toward the side of the load according to the movement of the rotary shaft from a predetermined position. The control apparatus prevents the jumping motion of the rotary shaft which occurs as the load increases to enable the directly motor-driven spindle assembly to operate at a high rotating speed without the jumping motion.

6 Claims, 9 Drawing Sheets

DIRECTLY MOTOR-DRIVEN SPINDLE ASSEMBLY

This is a continuation of application Ser. No. 07/639,108, filed Jan. 9, 1991, now abandoned.

BACKGROUND OF THE INVENTION

1. Field of the Invention

The present invention relates to a directly motor-driven spindle assembly for spinning machines, such as spinning frames and twisting frames, having a spindle blade securely restrained from jumping up.

2. Description of the Prior Art

Various means for restraining a spindle blade from jumping up have been proposed.

A first prior art disclosed in Japanese Patent Laid-open (Kokai) No. 64-52825 utilizes permanent magnets for attracting a rotary unit to a fixed unit by magnetic attraction.

A second prior art disclosed in Japanese Patent Laid-open (Kokai) No. 60-139153 employs a mechanism capable of generating a thrust by utilizing the axial component of force produced by the rotor with skew conductors of a motor.

The first prior art has no means for controlling the large vibration and jumping of the rotary unit; the magnetic attraction between the permanent magnets is reduced and become ineffective when the rotary unit jumps up a large distance.

Another prior art illustrates that the rotor of the motor of a sealed rotary compressor with skew conductors to generate a downward thrust and nothing is considered about generating a thrust according to an axial load on a rotary unit which rotates at a high speed. The axial component of force acts downward only when the rotary unit rotates in one direction and acts upward to promote the jumping up of the rotary unit when the rotary unit rotates in the opposite direction.

SUMMARY OF THE INVENTION

Accordingly, it is a first object of the present invention to provide a spindle assembly which is capable of stably rotating at a high rotating speed.

A second object of the present invention is to provide a spindle assembly having a spindle capable of rotating at a high rotating speed without jumping up even if the load thereon increases.

A third object of the present invention is to provide a spindle assembly having a spindle and being capable of effectively suppressing the vibration and jumping of the spindle regardless of the rotating direction of the spindle.

In one aspect of the present invention, a directly motor-driven spindle assembly comprises: spindle means pivotally supported at one end and connected to a load at the other end; driving means operatively connected with the spindle means to rotate the spindle means; and control means for controlling a force for suppressing the movement of the spindle means toward the load so that the force increases with the movement of the spindle means toward the load.

In one embodiment of the present invention, the driving means is an electric motor having a rotor fixedly mounted on the spindle means, and the control means increases the thrust biasing the spindle means downward according to the increase of the lag of the rotor from the rotating magnetic field of the electric motor.

In another embodiment of the present invention, the control means increases the thrust which bias the spindle means downward according to the upward movement of the spindle means.

The control means is noncontact means which generates a thrust that biases the spindle during the operation of the electric motor to control the upward axial movement of the spindle means.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

First Embodiment (FIGS. 1 to 5)

Figure 1:
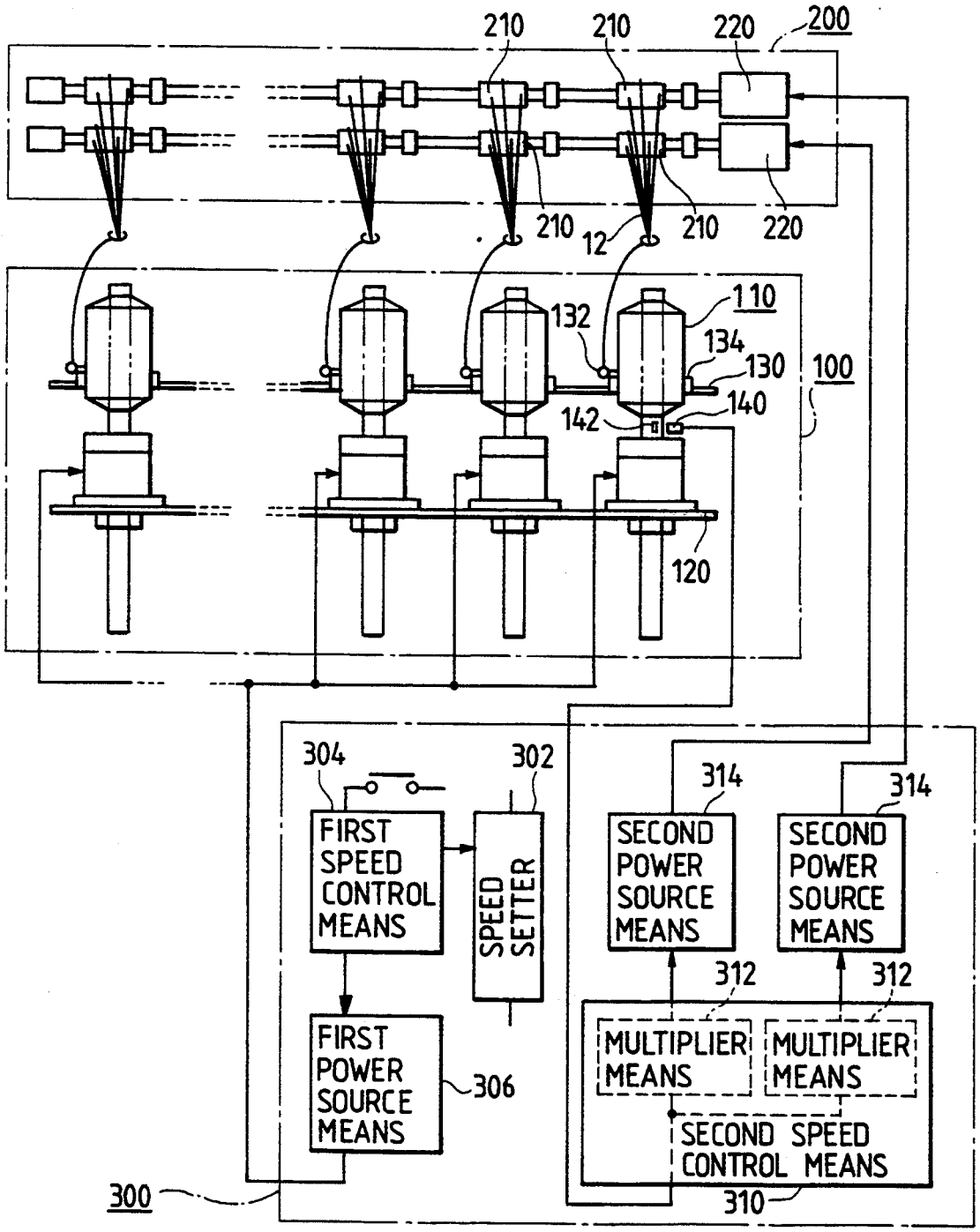
FIG. 1 is a block diagram of a control system for controlling a ring spinning frame provided with directly motor-driven spindle assemblies in a preferred embodiment according to the present invention.
Figure 2:
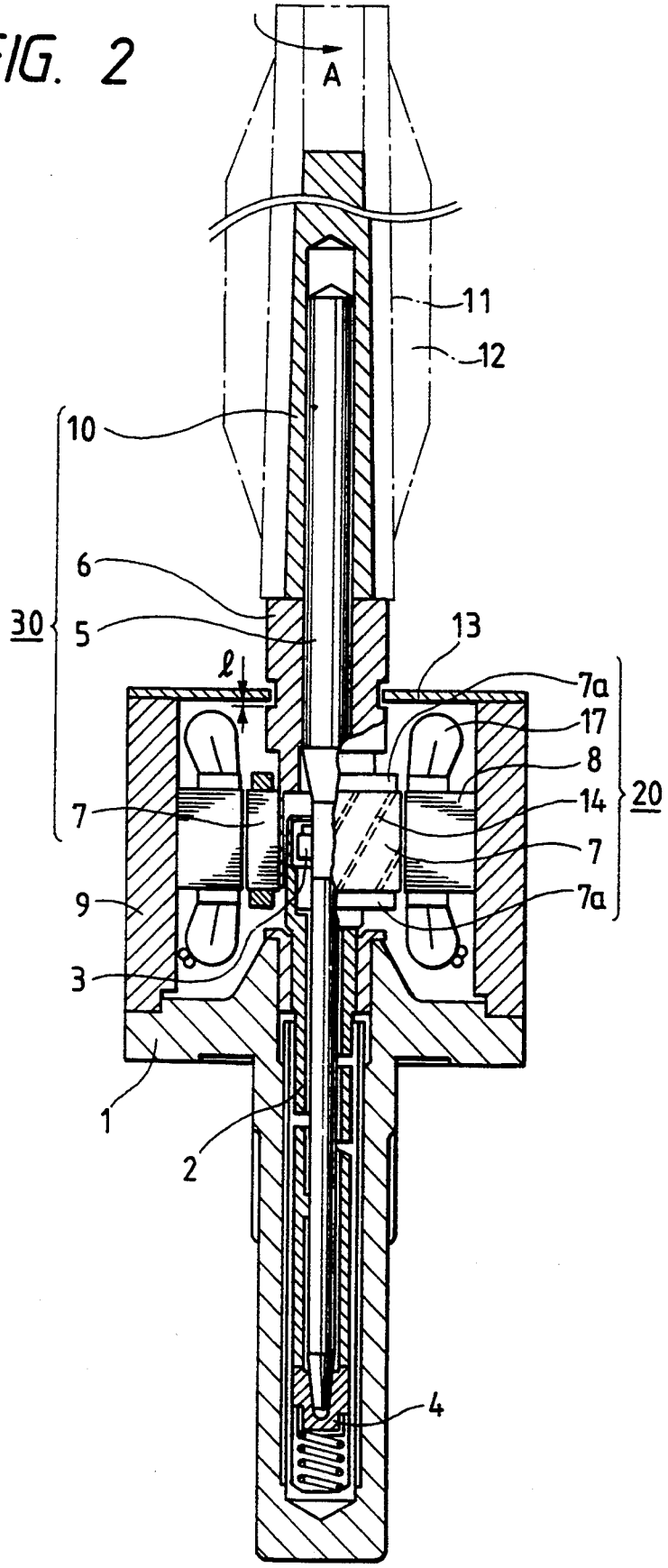
FIG. 2 is a longitudinal sectional view of one of the directly motor-driven spindle assemblies shown in FIG. 1.

A directly motor-driven spindle assembly (hereinafter referred to simply as "spindle assembly") in a first embodiment according to the present invention is an application of the present invention to a spindle assembly for a ring spinning frame. As shown in FIG. 1, the ring spinning frame includes a peripheral machinery means such as a drafting unit 200 for drafting rovings, a twisting and winding unit 100 for twisting fleeces and winding up yarns, and a control unit 300 for controlling the drafting unit 200 and the twisting and winding unit 100. The drafting unit 200 includes drafting rollers 210 for drafting the rovings, and motors 220 for rotatively driving the drafting rollers 210.

The twisting and winding unit 100 comprises a plurality of spindle assemblies 110, a spindle frame 120 for fixedly holding the spindle assemblies 110, and a ring rail 130. Each spindle assembly 110 comprises a spindle blade consisting of a lower spindle blade 5 and an upper spindle blade 10 fixed to the upper portion of the lower spindle blade 5, an electric motor 20 for rotatively driving the lower spindle blade 5, and a bolster 1 containing an insert bearing 2 supporting the lower spindle blade 5, and fixedly mounted on the spindle frame 120. Spinning rings 134 are arranged on the ring rail 130 so as to correspond respectively to the spindle assemblies 110, and are provided respectively with travelers 132 that slide along the corresponding spinning rings 134. The ring rail 130 are reciprocated vertically by a driving mechanism, not shown.

The control unit 300 comprises a speed setter 302 for setting a rotating speed for the spindle assemblies 110, a first speed control means 304, a first power source means 306, a second speed control means 310 for controlling the motors 220 for driving the drafting unit 200, and second power source means 314. The second speed control means 310 includes multipliers 312. The second speed control means 310 carries out a control operation as described in U.S. patent application Ser. No. 254,307 (1988) to control the rotating speed of the motors 220 in proportion to the rotating speed of the spindle assemblies 110 which are detected by a speed detector 140. The speed detector 140 is, for example, a magnetic sensor capable of sensing a variable magnetic field created by a permanent magnet 142 rotating together with the spindle blade of the spindle assembly 110.

The insert bearing 2 is provided with a thrust bearing 4 at its bottom to sustain the thrust of the spindle blade. The rotor 7 of the electric motor 20 is fixed coaxially to the lower spindle blade 5. The stator 8 of the electric motor 20 is disposed with a given gap between the rotor 7 and the stator 8. The rotor 7 is provided with skew conductors 14 as thrust generating means that generates a downward thrust according to the weight of a cop formed by winding the yarn 12 on a bobbin 11 put on the spindle blade. The lower portion of the lower spindle blade 5 is received in an upright position in the insert bearing 2 having a damping device and a spring and inserted in the bolster 1. The lower end of the lower spindle blade 5 is supported pivotally on the thrust bearing 4 provided at the lower end of the insert bearing 2. The lower spindle blade 5 is supported at its middle portion in a radial bearing 3 included in the insert bearing 2. The thrust bearing 4 is supported on a spiral flat spring having an appropriate spring constant and an appropriate damping characteristic in the bolster 1. The thrust bearing 4 sustains a weight on the lower spindle blade 5 and the radial bearing 3 suppresses the lateral runout of the lower spindle blade 5. A tubular member 6 is mounted coaxially on the middle portion of the lower spindle blade 5. The tubular member 6 has an upper portion fastened to the lower spindle blade 5 and a lower tubular portion having an open lower end and a small wall thickness. The rotor 7 of the electric motor 20 is fastened to the lower tubular portion of the tubular member 6.

Figure 3:
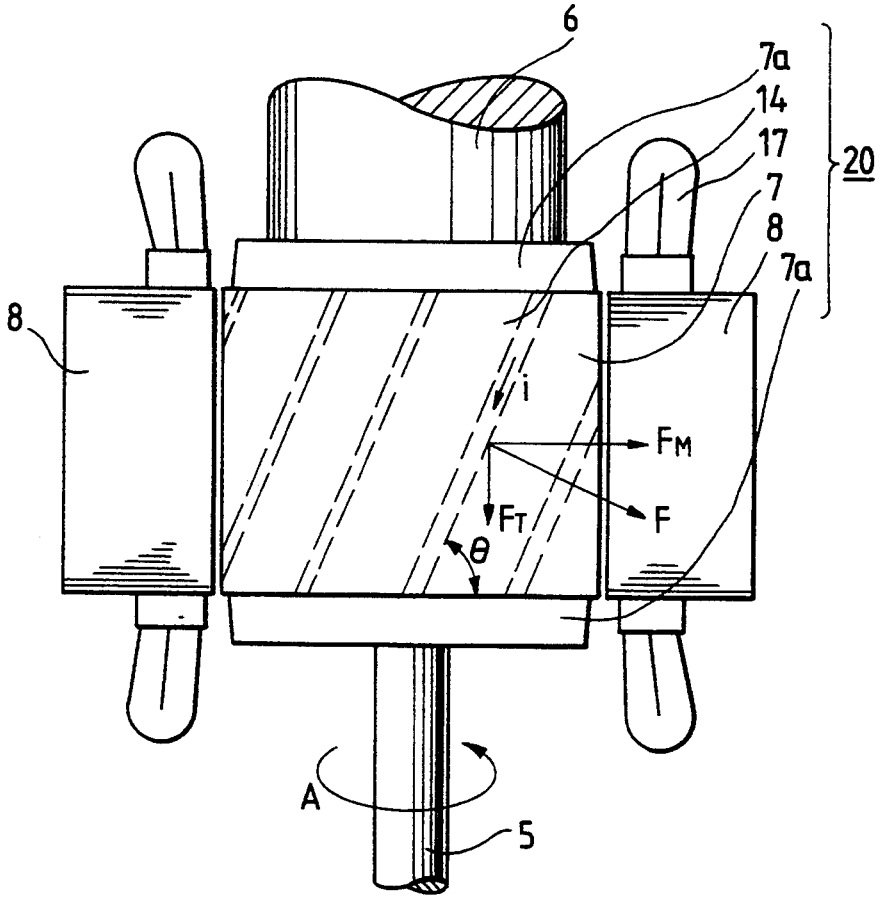
FIG. 3 is a fragmentary longitudinal sectional view of assistance in explaining forces acting on the rotor of the directly motor-driven spindle assembly of FIG. 2 during operation.

Referring to FIG. 3, the rotor 7 is provided with a squirrel cage consisting of the skew conductors 14 and end rings *7a* shorting the the skew conductors 14 at their ends. The rotor 7 is intended for rotation in the direction of an arrow A. The skew conductors 14 are skewed at an acute skew angle $\theta$ to the rotating direction. The stator 8 is provided with stator coils 17 mounted on a laminated stator core and is fastened securely to the inner circumference of a motor frame 9 (FIG. 2), which has an upper end covered with a cap 13 and a lower end fixed to the upper end of the bolster 1. The cap 13 is a split cap consisting of a plurality of plates. The inner circumference of the cap 13 is received in an annular groove formed in the outer circumference of the tubular member 6. A small gap of a gap width l is formed between the lower surface of the cap 13 and the lower side surface of the annular groove of the tubular member to allow the spindle blade to move slightly upward.

The lower spindle blade 5, the tubular member 6, the rotor 7 and the upper spindle blade 10 form a rotary unit 30. When the electric motor 20 is actuated the yarn 12 is wound around the bobbin 11 put on the upper spindle blade 10, while the load on the rotary unit 30 including the weight of the bobbin 11 and the layers of the yarn 12 wound on the bobbin 11 is sustained by the thrust bearing 4.

Figure 4:
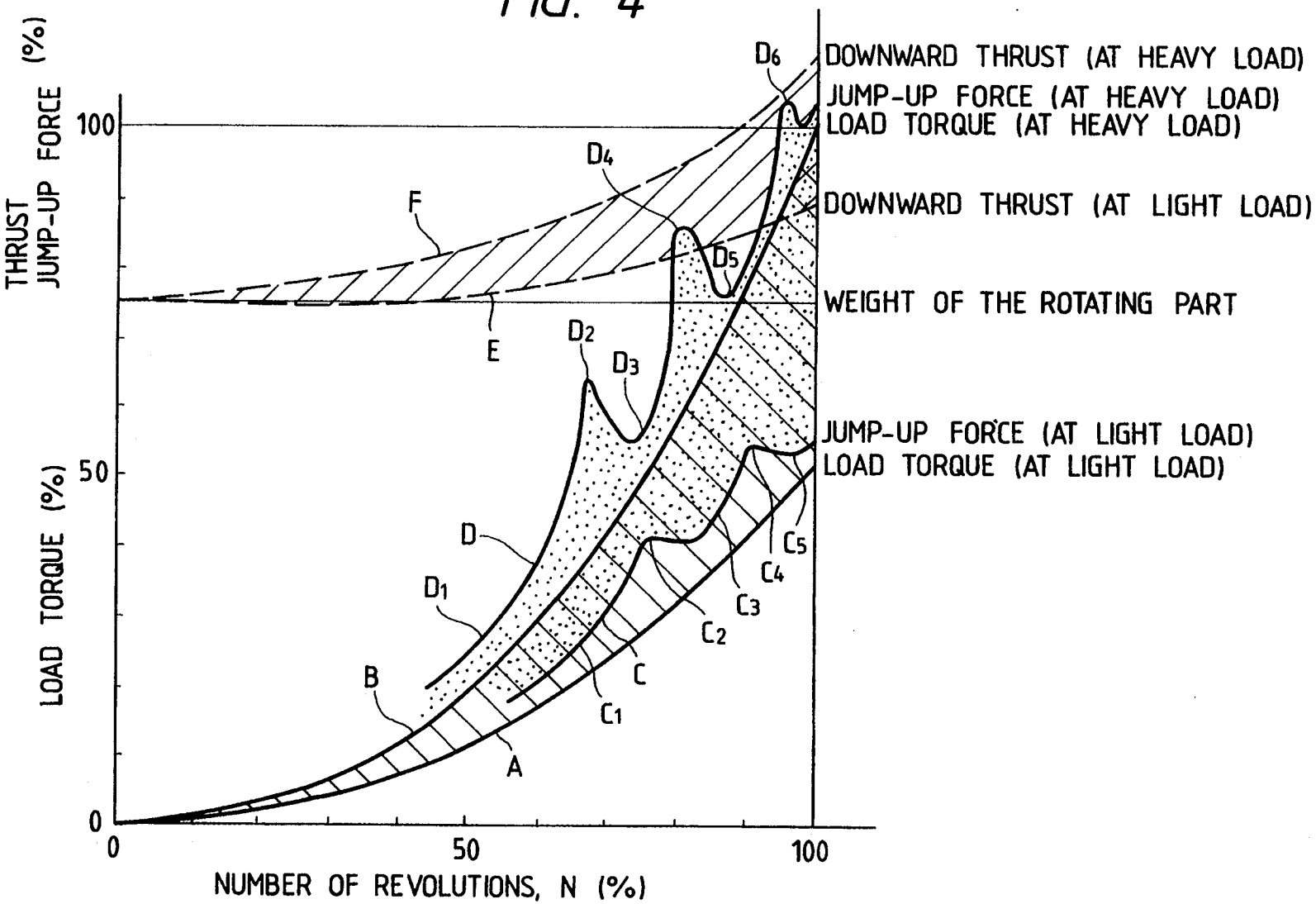
FIG. 4 is a graph showing the respective variations of load torque, upward thrust and downward thrust with rotating speed.

When the rotary unit 30 is rotated by the electric motor 20 at a high rotating speed, for example a rotating speed in the range of about 15,000 to 30,000 rpm, the rotary unit 30 performs a whirling motion on the radial bearing 3 due to the unbalanced layers of the yarn 12 wound on the bobbin 11. The degree of the whirling motion increases with increase in the weight of the yarns 12 wound on the bobbin 11 because the unbalanced state is enhanced as the weight of the yarn 12 wound on the bobbin 11 increases and, consequently, a jumping force, namely, a vertically upward force, of the rotary unit 30 increases. When the jumping force exceeds the weight of the rotary unit 30, the rotary unit 30 tends to jump up and vibrates vertically in a range corresponding to the gap width l. The jumping of the rotary unit 30 is liable to occur when the rotary unit 30 has many characteristic frequencies. As shown in FIG. 4, the jumping force reaches a peak at a rotating speed corresponding to each characteristic frequency. The load torque indicated by a curve A under a relatively light load and a curve B under a relatively heavy load in FIG. 4 is approximately proportional to the square or cube of the rotating speed. Curves C and D indicating the jumping force under different laden conditions have portions $C_1$, $C_3$, $C_5$, $D_1$, $D_3$ and $D_5$, which are proportional to the load torque, and peaks $C_2$, $C_4$, $D_2$, $D_4$ and $D_6$ which results from resonance at rotating speeds corresponding respectively to the characteristic frequencies of the rotary unit 30. The greater the load, the higher is the downward thrust generated by the rotor 7 provided with the skew conductors 14 as indicated by a curve E under a light load and a curve F under a heavy load. As is obvious from FIG. 4, since the downward thrust (curves E and F) is always higher than the jumping force (curves C and D), the rotary unit 30 is unable to jump up. In FIG. 4, the ratio of the rotating speed to a maximum rotating speed is measured in percentage on the horizontal axis, and the ratios of the load torque, the thrust and the jumping force respectively to a maximum load torque, a maximum thrust and a maximum jumping force are measured in percentage on the vertical axis. Thus, the jumping force of the rotary unit 30 is cancelled by the sum of the weight of the rotary unit 30 and the downward thrust generated by the skew conductors 14 to suppress the vibratory jumping of the rotary unit 30. The generation of the downward thrust will be described more specifically with reference to FIG. 3.

Figure 5:
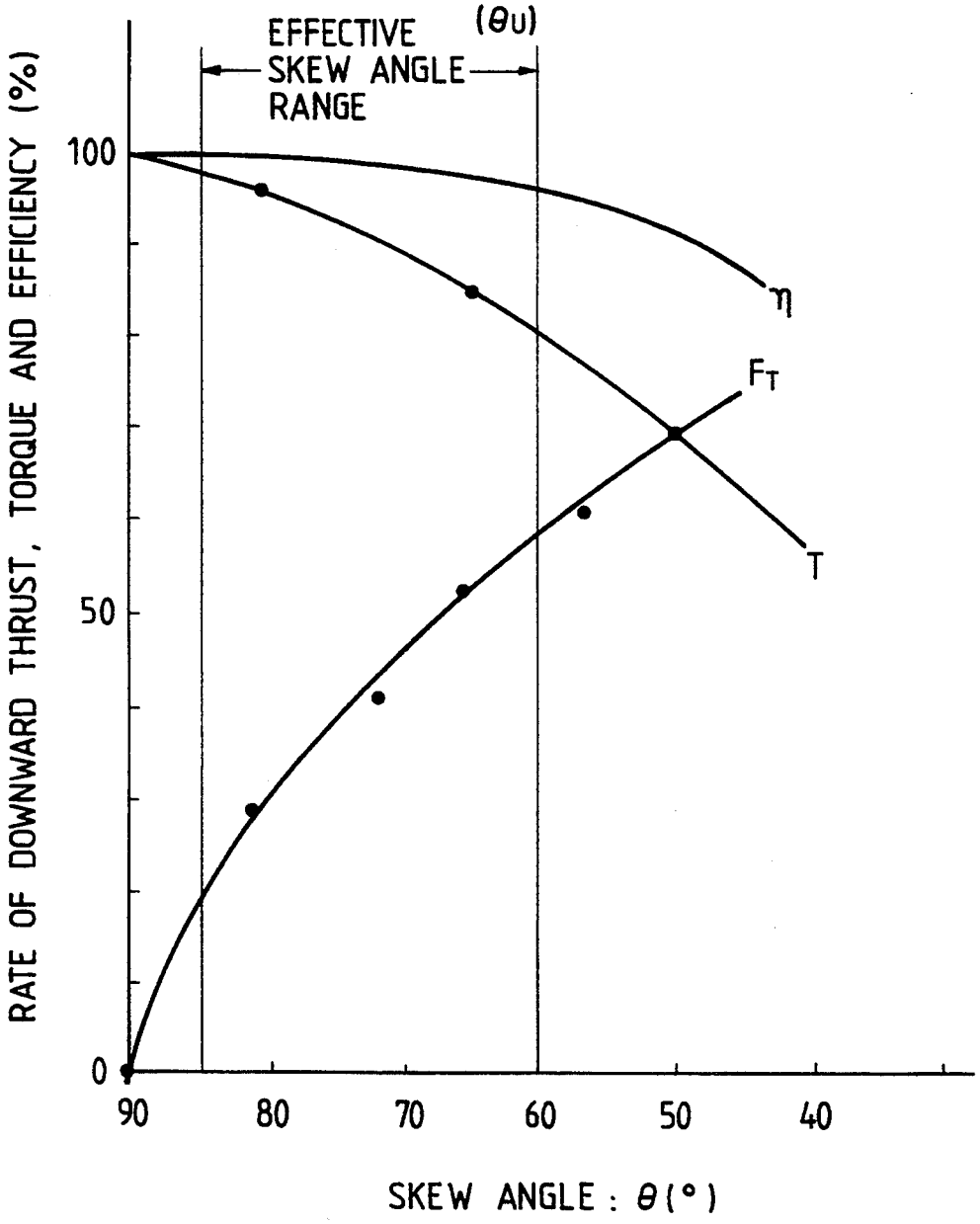
FIG. 5 is a graph showing the respective variations of downward thrust, torque and efficiency with skew angle.

Referring to FIG. 3, during the rotation of the rotor 7 put on the tubular member 6 in the direction of the arrow A, currents are induced in the skew conductors 14 contiguously arranged on the circumference of the rotor core by transformer action. The interaction between the induced current induced in each skew conductor 14 and the stator field created by the stator 8 produces a force F perpendicular to the skew conductor 14 and proportional to the product of the induced current and the flux of the magnetic field. The force F can be decomposed into a circumferential component force $F_M$ that produces a torque, and an axial component force $F_T$ that produces no torque. When the skew angle $\theta$ is an acute angle, the axial component force $F_T$ acts as a downward thrust that presses the rotary unit 30 against the thrust bearing 4. Since the axial component force $F_T$ is proportional to a rotor current i, i.e., the current induced in the skew conductor 14, and the rotor current i is approximately proportional to the torque of the rotary unit 30 when the slip of the rotor is relatively small, the thrust increases with the load on the rotary unit 30. Although the axial component force $F_T$ increases as the skew angle $\theta$ decreases, the circumferential component force $F_M$ decreases with the skew angle $\theta$ and, consequently, the torque T and the efficiency $\eta$ decreases as shown in FIG. 5. Accordingly, it is desirable that an effective skew angle range $\theta_u$ is between 85° and 60°. In such a desirable skew angle range, the reduction of the efficiency and that of the torque are not significant and the variation of the downward thrust is moderate. In FIG. 5, the efficiency $\eta$ and the torque T at a skew angle $\theta$ are expressed by the ratio in percent of the value of the efficiency $\eta$ when the skew angle is $\theta$ to the value of the same when the skew angle is 90°, and the ratio in percent of the value of the torque T when the skew angle is $\theta$ to the value of the same when the skew angle is 90°, respectively. The axial component force $F_T$ is expressed by the ratio in percent of the value of the axial component force $F_T$ when the skew angle is $\theta$ to the value of the same when the skew angle is 0°. As shown in FIG. 5, the axial component force $F_T$ is 20% of a maximum when $\theta=85°$, and the torque T is 80% of a maximum when $\theta=60°$. When the skew angle $\theta$ is in the range of 60° and 85°, an appropriate downward thrust is produced, the whirling motion and jumping motion of the rotary unit 30 can be suppressed properly without using any mechanical force.

Thus, the jumping of the rotary unit 30 is suppressed by the downward thrust produced by the skew arrangement of the rotor conductors 14. Therefore, any mechanical means for holding down the rotary unit 30 is not necessary, the suppression of the jumping motion of the rotary unit 30 does not entail any mechanical loss, and hence the rotary unit 30 is able to rotate at a high rotating speed. Furthermore, since any mechanical means, such as a bearing, for holding down the rotary unit 30 need not be provided above the rotor 7, the rotary unit 30 can readily be removed from the bolster 1, which facilitates work for the maintenance of the insert bearing 2, such as changing the lubricating oil contained in the bolster 1. Since the magnitude of the downward thrust is proportional to the currents induced in the rotor conductors 14 of the rotor 7, the downward thrust increases as the load, i.e., the quantity of the yarn 12 wound on the bobbin 11, on the rotary unit 30 increases. Still further, an unnecessarily excessive thrust is not applied to the thrust bearing 4, so that the abrasion of the thrust bearing 4 is reduced and the life of the same is extended.

Although the first embodiment has been described on an assumption that the bolster 1 is held on the spindle frame in a vertical position, the present invention is applicable additionally to a spindle assembly in which the bolster is held in a horizontal position. The present invention may be practiced in any similar motor-driven rotating device, such as a winding device, other than the spindle assembly for ring spinning frames.

Figure 6:
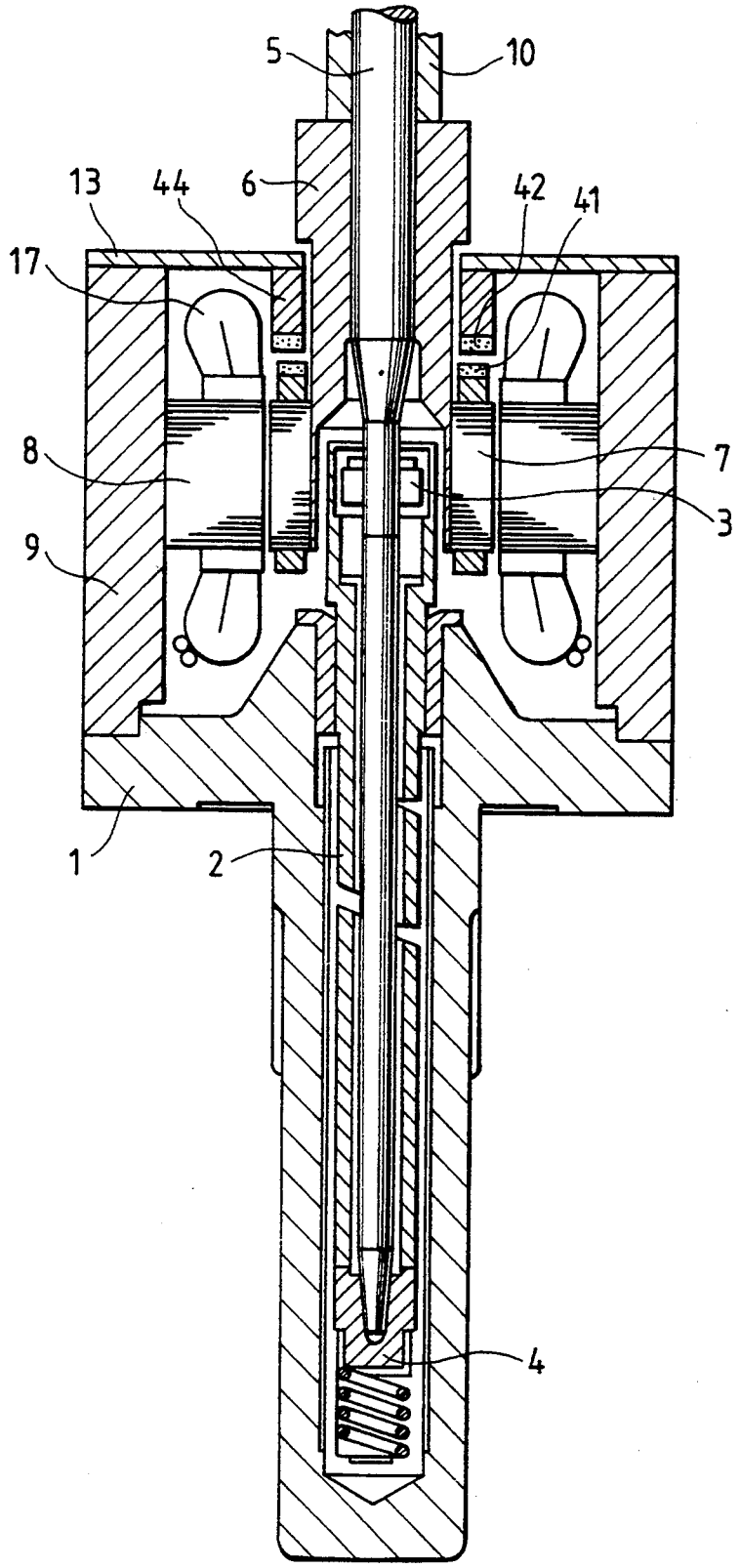
FIG. 6 is a longitudinal sectional view of a directly motor-driven spindle assembly in a second embodiment according to the present invention.
Figure 7:
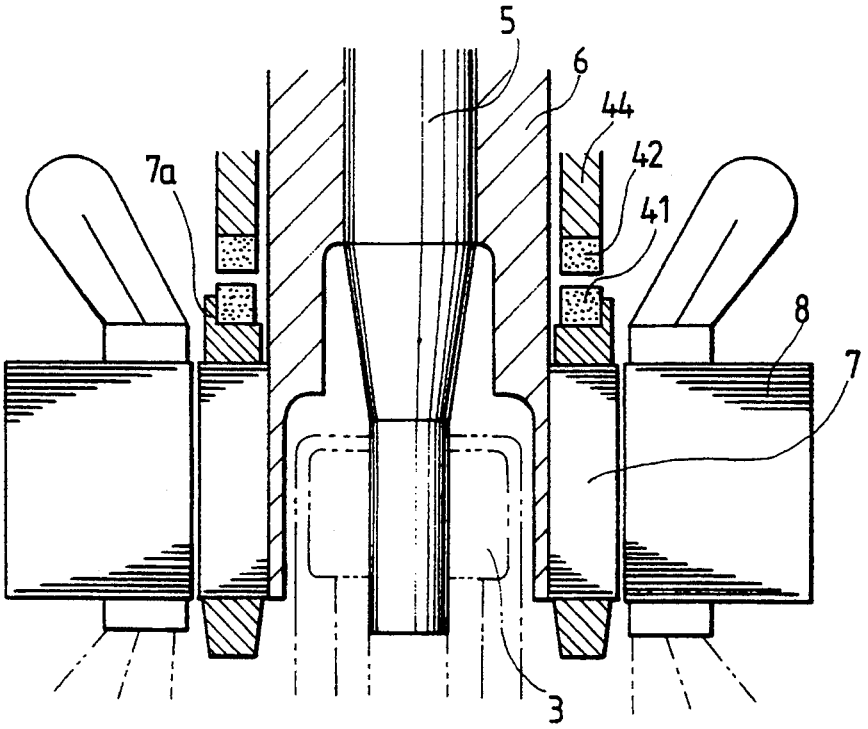
FIG. 7 is a fragmentary longitudinal sectional view of an essential portion of a modification of the directly motor-driven spindle assembly of FIG. 6.

Second Embodiment (FIGS. 6 and 7)

A spindle assembly in a second embodiment according to the present invention will be described with reference to FIG. 6, in which parts that are like or corresponding to those previously described with reference to FIGS. 1 to 4 are denoted by the same reference characters and the description thereof will be omitted to avoid duplication. The spindle assembly in the second embodiment employs a first permanent magnet ring 41 fixed to the upper end of a rotor 7, and a second permanent magnet ring 42 disposed axially opposite to the first permanent magnet ring 41 with a small gap therebetween and fixed to a holder 44 attached to a cap 13. The first permanent magnet ring 41 and the second permanent magnet ring 42 are magnetized so that the first permanent magnet ring 41 and the second permanent magnet ring 42 repulse each other.

When the rotary unit including the lower spindle blade 5 and the upper spindle blade 10 is rotated at a high rotating speed by the motor, the lower spindle blade 5 rotates in a whirling motion on the radial bearing 3 due to the rotation of the unbalanced bobbin and the unbalanced yarn layers wound on the bobbin. The greater the amount of yarn wound on the bobbin, the greater the unbalance in the rotary unit, and hence the greater the degree of whirling motion and, consequently, a vertical force acting on the rotary unit increases to cause the lower spindle blade 5 to vibrate vertically or to jump up. However, the repulsive force acting between the permanent magnet rings 41 and 42 suppresses the jumping motion of the lower spindle blade 5. Since the repulsive force increases sharply as the gap between the permanent magnet rings 41 and 42 decreases, the repulsive force suppresses the jumping motion of the lower spindle blade 5 effectively. In FIG. 6, indicated at 17 are stator coils.

FIG. 7 shows a modification of the spindle assembly in the second embodiment. In the modification, the first permanent magnet ring 41 is embedded in the end ring 7*a* of the rotor 7 so that the first permanent magnet ring 41 may not fall off the rotor 7 when the rotor 7 rotates at a high rotating speed. The first permanent magnet ring 41 may be held securely in place by a separate holding ring instead of being embedded in the end ring 7*a*.

Figure 8:
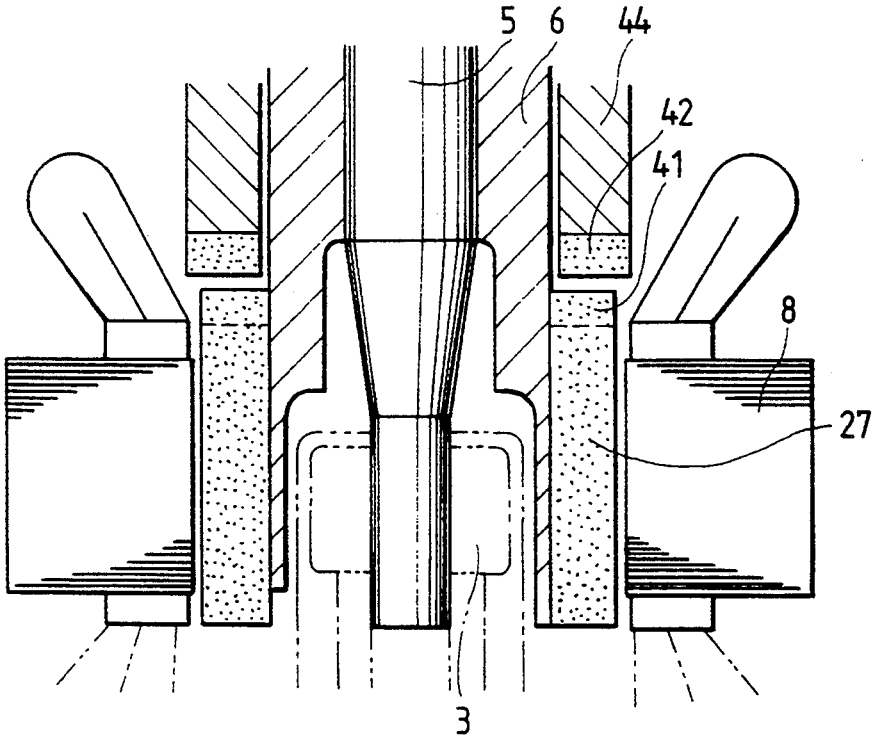
FIG. 8 is fragmentary longitudinal sectional view of an essential portion of a directly motor-driven spindle assembly in a third embodiment according to the present invention.
Figure 9:
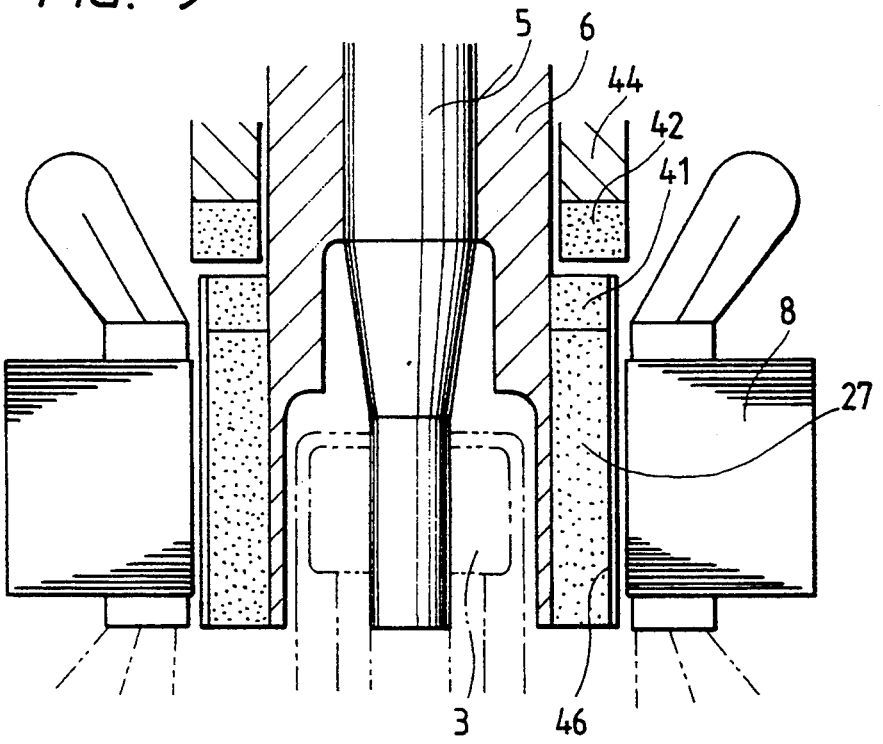
FIG. 9 is a fragmentary longitudinal sectional view of a modification of the directly motor-driven spindle assembly of FIG. 8.

Third Embodiment (FIGS. 8 and 9)

A third embodiment is an application of the present invention to a spindle assembly incorporating an electric motor employing a permanent magnet rotor 27 as shown in FIG. 8. A permanent magnet ring 41 corresponding to the first permanent magnet ring 41 of the second embodiment for producing repulsive force may be provided additionally or the upper end of the rotor 27 is available for producing repulsive force. The third embodiment is similar to the second embodiment in the rest of the components and construction.

FIG. 9 shows an electric motor employing a permanent magnet rotor 27 in a modification of the third embodiment. In this modification, the rotor 27 and the permanent magnet ring 41 are fitted in a reinforcing cylinder 46 so that the assembly of the rotor 27 and the permanent magnet ring 41 withstands rotation at a very high rotating speed to enhance the reliability of the electric motor.

Figure 10:
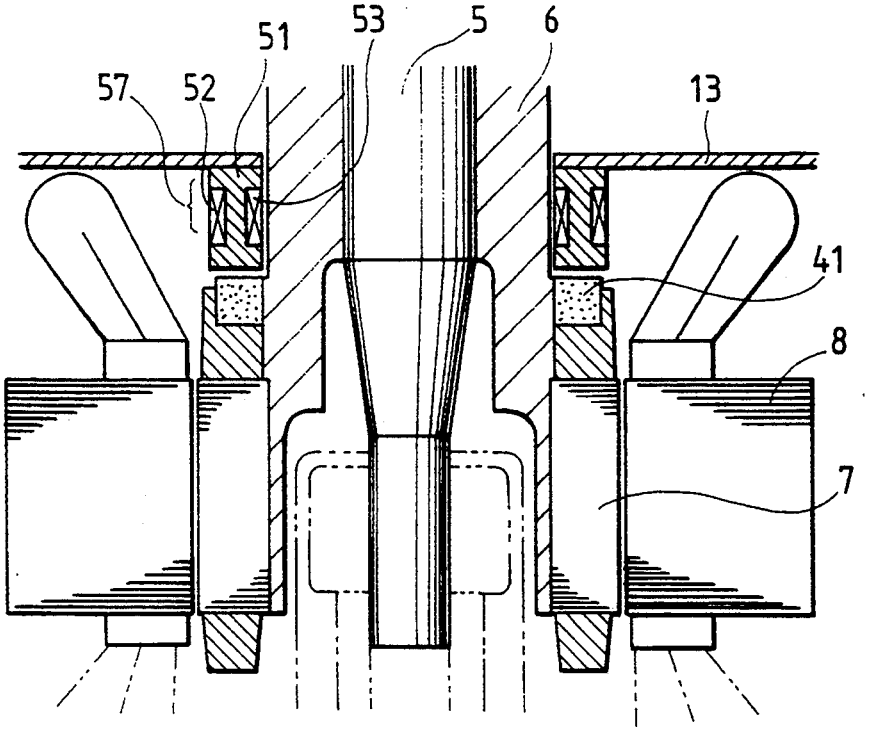
FIG. 10 is a fragmentary longitudinal sectional view of an essential portion of a directly motor-driven spindle assembly in a fourth embodiment according to the present invention.

Fourth Embodiment (FIG. 10)

A fourth embodiment is an application of the present invention to a spindle assembly incorporating an electric motor, which is similar to the electric motor in the second embodiment, except that the electric motor in the fourth embodiment employs an electromagnet ring 57 instead of the permanent magnet ring 42 employed in the electric motor in the second embodiment.

The electromagnet ring 57 consists of an annular core 51 having a cross section shaped as an I, an outer coil 52 and an inner coil 53. Currents are supplied to the coils 52 and 53 so that the magnetic polarity of the electromagnet ring 57 is opposite that of a permanent magnet ring 41 attached to the upper end of a rotor 7 to produce a repulsive force between the electromagnet ring 57 and the permanent magnet ring 41. A constant current is supplied to one of the coils 52 and 53 and current supplied to the other is regulated to regulate the repulsive force. When the rotor 7 must be stopped suddenly, the direction of the current supplied to the other coil is reversed for emergency braking.

Figure 11:
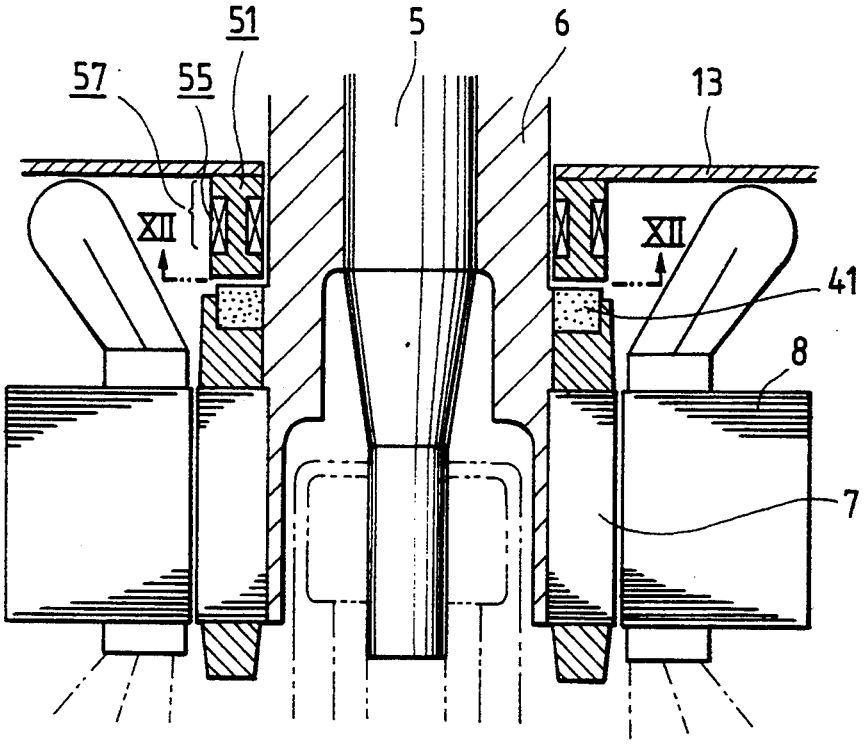
FIG. 11 is a fragmentary longitudinal sectional view of an essential portion of a directly motor-driven spindle assembly in a fifth embodiment according to the present invention.
Figure 12:
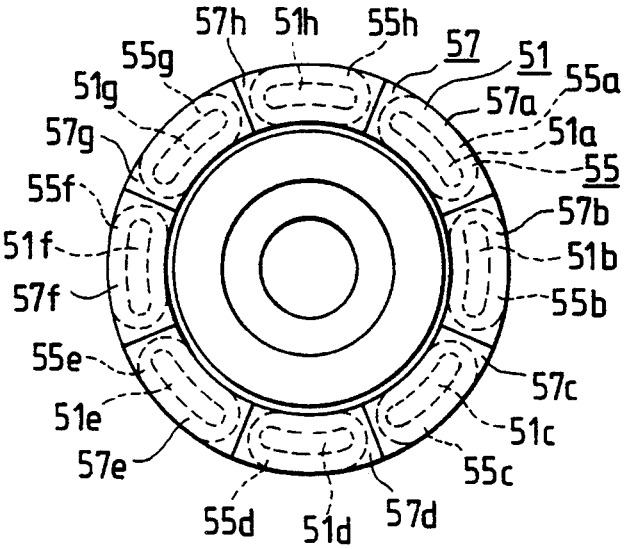
FIG. 12 is a sectional view of the directly motor-driven spindle assembly of FIG. 11.

Fifth Embodiment (FIGS. 11 and 12)

A fifth embodiment is an application of the present invention to a spindle assembly incorporating an electric motor, which is similar to the electric motor in the fourth embodiment, except that the electric motor in the fifth embodiment employs a split electromagnet 57 consisting of eight divisional electromagnets 57*a*, 57*b*, 57*c*, . . . and 57*h* arranged regularly on a circle. The divisional electromagnets 57*a*, 57*b*, 57*c*, . . . and 57*h* consist of cores 51*a*, 51*b*, 51*c*, . . . and 51*h*, and coils 55*a*, 55*b*, 55*c*, . . . and 55*h*, respectively.

During the normal operation, equal currents are supplied respectively to the electromagnets 57*a*, 57*b*, 57*c*, . . . and 57*h* and the currents are regulated simultaneously to regulate the repulsive force. It is possible to generate eddy currents in a permanent magnet ring 41 attached to the rotor 7 to brake the rotor 7 by magnetizing the electromagnets 57*a*, 57*b*, 57*c*, . . . and 57*h* alternately in different levels so that the magnetic flux distribution in the permanent magnet ring 41 varies regularly.

As is apparent from the foregoing description of the preferred embodiments of the present invention, the present invention applies a noncontact axial force to a rotary unit to restrain the rotary unit from axial movement, so that the rotary unit generates relatively small noise and the life of the thrust bearing can be extended.

Application of a relatively small thrust to the rotary unit while the rotary unit is rotating stably further extends the life of the thrust bearing.

The magnetic members for producing the repulsive force restraining the rotary unit from axial movement and the rotor provided with skew rotor conductors which produce a thrust biasing the rotary unit toward the thrust bearing may be employed in combination.

The spindle assembly in accordance with the present invention as applied to spinning frames or twisting frames is able to operate stably at a high rotating speed without significant vibrations, which enables the spinning frames or the twisting frames to operate silently and to produce yarns of a satisfactory quality.

In the spindle assemblies in the second to fifth embodiment, the vibration and jumping of the spindle can be effectively prevented regardless of the rotating direction of the rotary unit.

The vibration and jumping suppressing mechanisms employed in the second to fifth embodiments utilizing magnetic repulsion for suppressing the vibration and jumping of the rotary unit can be applied also to a spindle assembly not provided with any built-in electric motor and driven by a separate electric motor through a belt or the like.

What is claimed is:

1. A directly motor-driven spindle assembly comprising:

rotary shaft means for supporting a rotor of an electric induction motor and a load that varies in magnitude as the motor-driven spindle assembly is operated, said rotary shaft means having a lower portion, first bearing means rotatably supporting said rotary shaft means at said lower portion thereof, said rotary shaft means further having an upper portion connected to said load and a middle portion between said lower portion and said upper portion, second bearing means rotatably supporting said rotary shaft means at said middle portion thereof;

an electric induction motor operated by a first current varying in accordance with said load, said motor including a rotor fixedly mounted on the rotary shaft means and disposed so as to surround said second bearing means at a center portion of said rotor and a stator disposed so as to surround said rotor; and skew conductor means disposed on said rotor for generating a thrust force in accordance with a magnitude of a second current induced therein, said thrust force being in a downward direction, whereby a downward thrust of the rotary shaft means increases according to increasing of load without moving the rotary shaft means.

2. A directly motor-driven spindle assembly according to claim 1, wherein said skew conductor means is skew conductors arranged on said rotor.

3. A directly motor-driven spindle assembly according to claim 2, wherein a skew angle of the skew conductors to a rotating direction of the rotor is an acute angle.

4. A directly motor-driven spindle assembly according to claim 1, wherein said first bearing means includes a thrust bearing disposed within a bottom of a bolster and supporting one end of said rotary shaft means and the other end of said rotary shaft means being connected to a bobbin on which a yarn is wound, wherein said second bearing means supports the rotary shaft means at a position between the bolster and the bobbin, and said skew conductor means increases a thrust biasing the rotary shaft means toward the thrust bearing according to the increase in a weight of a cop formed by winding the yarn on the bobbin to control the movement of the rotary shaft means toward a side of the bobbin while the rotary shaft means is rotated by the electric motor.

5. A directly motor-driven spindle assembly comprising:

rotary shaft means for supporting a rotor of an electric induction motor and a load that varies in magnitude as the motor-driven spindle assembly is operated, said rotary shaft means having a lower portion, first bearing means rotatably supporting said rotary shaft means at said lower portion thereof, said rotary shaft means further having an upper portion connected to said load and a middle portion between said lower portion and said upper portion, second bearing means rotatably supporting said rotary shaft means at said middle portion thereof;

an electric induction motor operated by a first current varying in accordance with said load, said motor including a rotor fixedly mounted on the rotary shaft means and disposed so as to surround said second bearing means at a center portion of said rotor and a stator disposed so as to surround said rotor; and skew conductor means disposed on said rotor for generating a thrust force in accordance with a magnitude of a second current induced therein, said thrust force being in a downward direction, whereby a downward thrust of the rotary shaft means increases according to increasing of load without moving the rotary shaft means, and wherein said skew conductor means is skew conductors arranged on said rotor and wherein a skew angle of said skew conductors to a rotating direction of the rotor is an acute angle in a range of 60° to 85°.

6. A directly motor-driven spindle system comprising:

peripheral machinery means for supplying yarn;

spindle means for winding the yarn supplied by the peripheral machinery means, comprising rotary shaft means for supporting a rotor of an electric induction motor and a load that varies in magnitude as the motor-driven spindle assembly is operated, said rotary shaft means having a lower portion, an upper portion connected to said load, and a middle portion between said lower portion and said upper portion, first bearing means rotatably supporting said rotary shaft means at said lower portion thereof and second bearing means rotatably supporting said rotary shaft means at said middle portion thereof, an electric induction motor operated by a first current varying in response to said magnitude of said load, said motor including a rotor fixably mounted on the rotary shaft means and disposed so as to surround said second bearing means at a center portion of said rotor and a stator disposed so as to surround said rotor, and skew conductor means disposed on said rotor for generating a thrust force in accordance with a magnitude of a second current induced therein in a downward direction, whereby a downward thrust of the rotary shaft means increases according to increasing of load without moving the rotary shaft; and peripheral machinery control means for controlling the peripheral machinery means so that a ratio of an operating speed of the peripheral machinery means to an operating speed of the spindle means is maintained at a predetermined speed ratio.

* * * * *